US008141664B2

(12) United States Patent
Zahradnik et al.

(10) Patent No.: US 8,141,664 B2
(45) Date of Patent: Mar. 27, 2012

(54) HYBRID DRILL BIT WITH HIGH BEARING PIN ANGLES

(75) Inventors: Anton F. Zahradnik, Sugar Land, TX (US); Don Q. Nguyen, Houston, TX (US); Alan J. Massey, Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 316 days.

(21) Appl. No.: 12/397,094

(22) Filed: Mar. 3, 2009

(65) Prior Publication Data

US 2010/0224417 A1 Sep. 9, 2010

(51) Int. Cl.
*E21B 10/00* (2006.01)

(52) U.S. Cl. ..... 175/336

(58) Field of Classification Search ..... 175/336
See application file for complete search history.

(56) References Cited

U.S. PATENT DOCUMENTS

| | | | | | |
|---|---|---|---|---|---|
| 930,759 | A | | 8/1909 | Hughes | |
| 1,388,424 | A | | 9/1921 | George | |
| 1,394,769 | A | | 10/1921 | Sorensen | |
| 1,519,641 | A | | 12/1924 | Thompson | |
| 1,816,568 | A | | 7/1931 | Carlson | |
| 1,821,474 | A | | 9/1931 | Mercer | |
| 1,874,066 | A | * | 8/1932 | Scott et al. | 175/336 |
| 1,879,127 | A | * | 9/1932 | Schlumpf | 175/336 |
| 1,896,243 | A | | 2/1933 | Macdonald | |
| 1,932,487 | A | | 10/1933 | Scott | |
| 2,030,722 | A | | 2/1936 | Scott | |
| 2,117,481 | A | | 5/1938 | Howard et al. | |
| 2,119,618 | A | | 6/1938 | Zublin | |
| 2,198,849 | A | | 4/1940 | Waxler | |
| 2,216,894 | A | | 10/1940 | Stancliff | |
| 2,244,537 | A | * | 6/1941 | Kammerer | 175/333 |
| 2,297,157 | A | * | 9/1942 | McClinton | 175/336 |
| 2,320,136 | A | * | 5/1943 | Kammerer | 175/333 |
| 2,320,137 | A | * | 5/1943 | Kammerer | 175/333 |
| 2,380,112 | A | * | 7/1945 | Kinnear | 175/336 |
| RE23,416 | E | * | 10/1951 | Kinnear | 175/336 |
| 2,719,026 | A | * | 9/1955 | Boice | 175/336 |
| 2,815,932 | A | | 12/1957 | Wolfram | |
| 2,994,389 | A | | 8/1961 | Bus, Sr. | |

(Continued)

FOREIGN PATENT DOCUMENTS

DE 13 01 784 8/1969

(Continued)

OTHER PUBLICATIONS

Beijer, G., International Preliminary Report on Patentability for International Patent Application No. PCT/US2009/042514, The International Bureau of WIPO, dated Nov. 2, 2010.

(Continued)

*Primary Examiner* — Jennifer H Gay
(74) *Attorney, Agent, or Firm* — Locke Lord LLP

(57) ABSTRACT

A hybrid drill bit having at least two rolling cutters, each rotatable around an axis of rotation, at least one of the rolling cutters having a high pin angle, and at least one fixed blade. The pin angle can encompass pin angles above 39 degrees to less than 393 degrees. The drill bit can allow the rolling cutters to engage a shoulder portion and/or gage portion of the bit profile and assist the fixed blade(s) in these areas. The at least two rolling cutters can be disposed at different pin angles.

15 Claims, 10 Drawing Sheets

U.S. PATENT DOCUMENTS

| | | | | | |
|---|---|---|---|---|---|
| 3,010,708 | A | | 11/1961 | Hlinsky et al. | |
| 3,050,293 | A | | 8/1962 | Hlinsky | |
| 3,055,443 | A | | 9/1962 | Edwards | |
| 3,066,749 | A | * | 12/1962 | Hildebrandt | 175/317 |
| 3,126,066 | A | * | 3/1964 | Williams, Jr. | 175/336 |
| 3,126,067 | A | | 3/1964 | Schumacher, Jr. | |
| 3,174,564 | A | | 3/1965 | Morlan | |
| 3,239,431 | A | | 3/1966 | Raymond | |
| 3,250,337 | A | | 5/1966 | Demo | |
| 3,269,469 | A | * | 8/1966 | Kelly, Jr | 175/336 |
| 3,387,673 | A | | 6/1968 | Thompson | |
| 3,424,258 | A | | 1/1969 | Nakayama | |
| 3,583,501 | A | | 6/1971 | Aalund | |
| RE28,625 | E | | 11/1975 | Cunningham | |
| 4,006,788 | A | | 2/1977 | Garner | |
| 4,140,189 | A | | 2/1979 | Garner | |
| 4,190,126 | A | | 2/1980 | Kabashima | |
| 4,270,812 | A | | 6/1981 | Thomas | |
| 4,285,409 | A | * | 8/1981 | Allen | 175/336 |
| 4,293,048 | A | | 10/1981 | Kloesel, Jr. | |
| 4,320,808 | A | | 3/1982 | Garrett | |
| 4,343,371 | A | * | 8/1982 | Baker et al. | 175/430 |
| 4,359,112 | A | * | 11/1982 | Garner et al. | 175/428 |
| 4,369,849 | A | | 1/1983 | Parrish | |
| 4,386,669 | A | | 6/1983 | Evans | |
| 4,410,284 | A | | 10/1983 | Herrick | |
| 4,428,687 | A | | 1/1984 | Zahradnik | |
| 4,444,281 | A | * | 4/1984 | Schumacher et al. | 175/336 |
| 4,527,637 | A | | 7/1985 | Bodine | |
| 4,572,306 | A | | 2/1986 | Dorosz | |
| 4,657,091 | A | | 4/1987 | Higdon | |
| 4,664,705 | A | | 5/1987 | Horton et al. | |
| 4,690,228 | A | | 9/1987 | Voelz et al. | |
| 4,706,765 | A | | 11/1987 | Lee et al. | |
| 4,726,718 | A | | 2/1988 | Meskin et al. | |
| 4,727,942 | A | | 3/1988 | Galle et al. | |
| 4,738,322 | A | | 4/1988 | Hall et al. | |
| 4,765,205 | A | | 8/1988 | Higdon | |
| 4,874,047 | A | | 10/1989 | Hixon | |
| 4,875,532 | A | | 10/1989 | Langford, Jr. | |
| 4,892,159 | A | | 1/1990 | Holster | |
| 4,915,181 | A | | 4/1990 | Labrosse | |
| 4,932,484 | A | | 6/1990 | Warren et al. | |
| 4,936,398 | A | * | 6/1990 | Auty et al. | 175/336 |
| 4,943,488 | A | | 7/1990 | Sung et al. | |
| 4,953,641 | A | | 9/1990 | Pessier | |
| 4,976,324 | A | | 12/1990 | Tibbitts | |
| 4,984,643 | A | | 1/1991 | Isbell et al. | |
| 4,991,671 | A | | 2/1991 | Pearce et al. | |
| 5,016,718 | A | | 5/1991 | Tandberg | |
| 5,027,912 | A | | 7/1991 | Juergens | |
| 5,028,177 | A | | 7/1991 | Meskin et al. | |
| 5,030,276 | A | | 7/1991 | Sung et al. | |
| 5,049,164 | A | | 9/1991 | Horton et al. | |
| 5,116,568 | A | | 5/1992 | Sung et al. | |
| 5,145,017 | A | | 9/1992 | Holster et al. | |
| 5,176,212 | A | | 1/1993 | Tandberg | |
| 5,224,560 | A | | 7/1993 | Fernandez | |
| 5,238,074 | A | | 8/1993 | Tibbitts et al. | |
| 5,287,936 | A | | 2/1994 | Grimes et al. | |
| 5,289,889 | A | | 3/1994 | Gearhart et al. | |
| 5,337,843 | A | | 8/1994 | Torgrimsen et al. | |
| 5,346,026 | A | | 9/1994 | Pessier et al. | |
| 5,351,770 | A | | 10/1994 | Cawthorne et al. | |
| 5,361,859 | A | | 11/1994 | Tibbitts | |
| 5,429,200 | A | | 7/1995 | Blackman et al. | |
| 5,439,068 | A | | 8/1995 | Huffstutler et al. | |
| 5,452,771 | A | | 9/1995 | Blackman et al. | |
| 5,467,836 | A | | 11/1995 | Grimes et al. | |
| 5,472,057 | A | | 12/1995 | Winfree | |
| 5,472,271 | A | | 12/1995 | Bowers et al. | |
| 5,513,715 | A | | 5/1996 | Dysart | |
| 5,518,077 | A | | 5/1996 | Blackman et al. | |
| 5,547,033 | A | | 8/1996 | Campos, Jr. | |
| 5,553,681 | A | | 9/1996 | Huffstutler et al. | |
| 5,558,170 | A | | 9/1996 | Thigpen et al. | |
| 5,560,440 | A | | 10/1996 | Tibbitts | |
| 5,570,750 | A | | 11/1996 | Williams | |
| 5,593,231 | A | | 1/1997 | Ippolito | |
| 5,606,895 | A | | 3/1997 | Huffstutler | |
| 5,624,002 | A | | 4/1997 | Huffstutler | |
| 5,641,029 | A | | 6/1997 | Beaton et al. | |
| 5,644,956 | A | | 7/1997 | Blackman et al. | |
| 5,655,612 | A | | 8/1997 | Grimes et al. | |
| D384,084 | S | | 9/1997 | Huffstutler et al. | |
| 5,695,018 | A | | 12/1997 | Pessier et al. | |
| 5,695,019 | A | | 12/1997 | Shamburger, Jr. | |
| 5,755,297 | A | | 5/1998 | Young et al. | |
| 5,862,871 | A | | 1/1999 | Curlett | |
| 5,868,502 | A | | 2/1999 | Cariveau et al. | |
| 5,873,422 | A | | 2/1999 | Hansen et al. | |
| 5,941,322 | A | | 8/1999 | Stephenson et al. | |
| 5,944,125 | A | | 8/1999 | Byrd | |
| 5,967,246 | A | | 10/1999 | Caraway et al. | |
| 5,979,576 | A | | 11/1999 | Hansen et al. | |
| 5,988,303 | A | | 11/1999 | Arfele | |
| 5,992,542 | A | | 11/1999 | Rives | |
| 5,996,713 | A | | 12/1999 | Pessier et al. | |
| 6,092,613 | A | | 7/2000 | Caraway et al. | |
| 6,095,265 | A | | 8/2000 | Alsup | |
| 6,109,375 | A | | 8/2000 | Tso | |
| 6,116,357 | A | | 9/2000 | Wagoner et al. | |
| 6,173,797 | B1 | | 1/2001 | Dykstra et al. | |
| 6,220,374 | B1 | | 4/2001 | Crawford | |
| 6,241,034 | B1 | | 6/2001 | Steinke et al. | |
| 6,241,036 | B1 | | 6/2001 | Lovato et al. | |
| 6,250,407 | B1 | | 6/2001 | Karlsson | |
| 6,260,635 | B1 | | 7/2001 | Crawford | |
| 6,279,671 | B1 | | 8/2001 | Panigrahi et al. | |
| 6,283,233 | B1 | | 9/2001 | Lamine et al. | |
| 6,296,069 | B1 | | 10/2001 | Lamine et al. | |
| RE37,450 | E | | 11/2001 | Deken et al. | |
| 6,345,673 | B1 | | 2/2002 | Siracki | |
| 6,360,831 | B1 | | 3/2002 | Akesson et al. | |
| 6,367,568 | B2 | | 4/2002 | Steinke et al. | |
| 6,386,302 | B1 | | 5/2002 | Beaton | |
| 6,401,844 | B1 | | 6/2002 | Doster et al. | |
| 6,405,811 | B1 | | 6/2002 | Borchardt | |
| 6,408,958 | B1 | | 6/2002 | Isbell et al. | |
| 6,415,687 | B2 | | 7/2002 | Saxman | |
| 6,439,326 | B1 | | 8/2002 | Huang et al. | |
| 6,446,739 | B1 | | 9/2002 | Richman et al. | |
| 6,450,270 | B1 | | 9/2002 | Saxton | |
| 6,460,635 | B1 | | 10/2002 | Kalsi et al. | |
| 6,474,424 | B1 | | 11/2002 | Saxman | |
| 6,510,906 | B1 | | 1/2003 | Richert et al. | |
| 6,510,909 | B2 | | 1/2003 | Portwood et al. | |
| 6,527,066 | B1 | | 3/2003 | Rives | |
| 6,533,051 | B1 | | 3/2003 | Singh et al. | |
| 6,544,308 | B2 | | 4/2003 | Griffin et al. | |
| 6,562,462 | B2 | | 5/2003 | Griffin et al. | |
| 6,568,490 | B1 | | 5/2003 | Tso et al. | |
| 6,581,700 | B2 | | 6/2003 | Curlett et al. | |
| 6,585,064 | B2 | | 7/2003 | Griffin et al. | |
| 6,589,640 | B2 | | 7/2003 | Griffin et al. | |
| 6,592,985 | B2 | | 7/2003 | Griffin et al. | |
| 6,601,661 | B2 | | 8/2003 | Baker et al. | |
| 6,601,662 | B2 | | 8/2003 | Matthias et al. | |
| 6,684,967 | B2 | | 2/2004 | Mensa-Wilmot et al. | |
| 6,729,418 | B2 | | 5/2004 | Slaughter, Jr. et al. | |
| 6,739,214 | B2 | | 5/2004 | Griffin et al. | |
| 6,742,607 | B2 | | 6/2004 | Beaton | |
| 6,745,858 | B1 | | 6/2004 | Estes | |
| 6,749,033 | B2 | | 6/2004 | Griffin et al. | |
| 6,797,326 | B2 | | 9/2004 | Griffin et al. | |
| 6,823,951 | B2 | | 11/2004 | Yong et al. | |
| 6,843,333 | B2 | | 1/2005 | Richert et al. | |
| 6,861,098 | B2 | | 3/2005 | Griffin et al. | |
| 6,861,137 | B2 | | 3/2005 | Griffin et al. | |
| 6,878,447 | B2 | | 4/2005 | Griffin et al. | |
| 6,883,623 | B2 | | 4/2005 | McCormick et al. | |
| 6,902,014 | B1 | | 6/2005 | Estes | |
| 6,986,395 | B2 | | 1/2006 | Chen | |
| 6,988,569 | B2 | | 1/2006 | Lockstedt et al. | |
| 7,096,978 | B2 | | 8/2006 | Dykstra et al. | |
| 7,111,694 | B2 | | 9/2006 | Beaton | |
| 7,137,460 | B2 | | 11/2006 | Slaughter, Jr. et al. | |

| | | | | |
|---|---|---|---|---|
| 7,152,702 | B1 | 12/2006 | Bhome et al. | |
| 7,197,806 | B2 | 4/2007 | Boudreaux et al. | |
| 7,198,119 | B1 | 4/2007 | Hall et al. | |
| 7,234,550 | B2 | 6/2007 | Azar et al. | |
| 7,270,196 | B2 | 9/2007 | Hall | |
| 7,281,592 | B2 | 10/2007 | Runia et al. | |
| 7,320,375 | B2 | 1/2008 | Singh | |
| 7,350,568 | B2 | 4/2008 | Mandal et al. | |
| 7,350,601 | B2 | 4/2008 | Belnap et al. | |
| 7,360,612 | B2 | 4/2008 | Chen et al. | |
| 7,377,341 | B2 | 5/2008 | Middlemiss et al. | |
| 7,387,177 | B2 | 6/2008 | Zahradnik et al. | |
| 7,392,862 | B2 | 7/2008 | Zahradnik et al. | |
| 7,398,837 | B2 | 7/2008 | Hall et al. | |
| 7,416,036 | B2 | 8/2008 | Forstner et al. | |
| 7,435,478 | B2 | 10/2008 | Keshavan | |
| 7,462,003 | B2 | 12/2008 | Middlemiss | |
| 7,473,287 | B2 | 1/2009 | Belnap et al. | |
| 7,493,973 | B2 | 2/2009 | Keshavan et al. | |
| 7,517,589 | B2 | 4/2009 | Eyre | |
| 7,533,740 | B2 | 5/2009 | Zhang et al. | |
| 7,568,534 | B2 | 8/2009 | Griffin et al. | |
| 7,621,346 | B1 | 11/2009 | Trinh et al. | |
| 7,621,348 | B2 | 11/2009 | Hoffmaster et al. | |
| 7,703,556 | B2 | 4/2010 | Smith et al. | |
| 7,703,557 | B2 | 4/2010 | Durairajan et al. | |
| 7,819,208 | B2 * | 10/2010 | Pessier et al. | 175/336 |
| 7,836,975 | B2 | 11/2010 | Chen et al. | |
| 7,845,435 | B2 * | 12/2010 | Zahradnik et al. | 175/336 |
| 7,845,437 | B2 | 12/2010 | Bielawa et al. | |
| 7,847,437 | B2 | 12/2010 | Chakrabarti et al. | |
| 2002/0092684 | A1 | 7/2002 | Singh et al. | |
| 2002/0108785 | A1 | 8/2002 | Slaughter, Jr. et al. | |
| 2004/0099448 | A1 | 5/2004 | Fielder et al. | |
| 2004/0238224 | A1 | 12/2004 | Runia | |
| 2005/0087370 | A1 | 4/2005 | Ledgerwood, III et al. | |
| 2005/0103533 | A1 | 5/2005 | Sherwood, Jr. et al. | |
| 2005/0178587 | A1 | 8/2005 | Witman, IV et al. | |
| 2005/0183892 | A1 | 8/2005 | Oldham et al. | |
| 2005/0263328 | A1 | 12/2005 | Middlemiss | |
| 2005/0273301 | A1 | 12/2005 | Huang | |
| 2006/0032674 | A1 | 2/2006 | Chen et al. | |
| 2006/0032677 | A1 | 2/2006 | Azar et al. | |
| 2006/0162969 | A1 | 7/2006 | Belnap et al. | |
| 2006/0196699 | A1 | 9/2006 | Estes et al. | |
| 2006/0254830 | A1 | 11/2006 | Radtke | |
| 2006/0266558 | A1 | 11/2006 | Middlemiss et al. | |
| 2006/0266559 | A1 | 11/2006 | Keshavan et al. | |
| 2006/0278442 | A1 | 12/2006 | Kristensen | |
| 2006/0283640 | A1 | 12/2006 | Estes et al. | |
| 2007/0029114 | A1 | 2/2007 | Middlemiss | |
| 2007/0062736 | A1 | 3/2007 | Cariveau et al. | |
| 2007/0079994 | A1 | 4/2007 | Middlemiss | |
| 2007/0131457 | A1 * | 6/2007 | McDonough et al. | 175/374 |
| 2007/0187155 | A1 | 8/2007 | Middlemiss | |
| 2007/0221417 | A1 | 9/2007 | Hall et al. | |
| 2008/0066970 | A1 | 3/2008 | Zahradnik et al. | |
| 2008/0264695 | A1 * | 10/2008 | Zahradnik et al. | 175/336 |
| 2008/0296068 | A1 * | 12/2008 | Zahradnik et al. | 175/341 |
| 2009/0114454 | A1 | 5/2009 | Belnap et al. | |
| 2009/0120693 | A1 | 5/2009 | McClain et al. | |
| 2009/0126998 | A1 | 5/2009 | Zahradnik et al. | |
| 2009/0159338 | A1 | 6/2009 | Buske | |
| 2009/0159341 | A1 | 6/2009 | Pessier et al. | |
| 2009/0166093 | A1 | 7/2009 | Pessier et al. | |
| 2009/0178855 | A1 | 7/2009 | Zhang et al. | |
| 2009/0183925 | A1 | 7/2009 | Zhang et al. | |
| 2009/0272582 | A1 * | 11/2009 | McCormick et al. | 175/336 |
| 2010/0018777 | A1 * | 1/2010 | Pessier et al. | 175/350 |
| 2010/0025119 | A1 * | 2/2010 | Stauffer | 175/341 |
| 2010/0155145 | A1 * | 6/2010 | Pessier et al. | 175/336 |
| 2010/0155146 | A1 * | 6/2010 | Nguyen et al. | 175/336 |
| 2010/0181292 | A1 * | 7/2010 | Stauffer et al. | 219/74 |
| 2010/0224417 | A1 * | 9/2010 | Zahradnik et al. | 175/336 |
| 2010/0270085 | A1 * | 10/2010 | Turner et al. | 175/381 |
| 2010/0276205 | A1 | 11/2010 | Oxford et al. | |
| 2010/0288561 | A1 * | 11/2010 | Zahradnik et al. | 175/336 |
| 2010/0320001 | A1 * | 12/2010 | Kulkarni | 175/336 |
| 2011/0024197 | A1 | 2/2011 | Centala et al. | |
| 2011/0079440 | A1 | 4/2011 | Buske et al. | |
| 2011/0079441 | A1 | 4/2011 | Buske et al. | |
| 2011/0079442 | A1 | 4/2011 | Buske et al. | |
| 2011/0079443 | A1 | 4/2011 | Buske et al. | |
| 2011/0162893 | A1 | 7/2011 | Zhang | |

FOREIGN PATENT DOCUMENTS

| | | |
|---|---|---|
| EP | 0225101 | 6/1987 |
| EP | 0157278 | 11/1989 |
| EP | 0391683 | 1/1996 |
| EP | 0874128 | 10/1998 |
| EP | 2089187 | 8/2009 |
| GB | 2183694 | 6/1987 |
| JP | 2000080878 | 3/2000 |
| JP | 2001159289 | 6/2001 |
| SU | 1 331 988 | 8/1987 |
| WO | 8502223 | 5/1985 |
| WO | 2008124572 | 10/2008 |

OTHER PUBLICATIONS

Jung Hye Lee, International Search Report for International Patent Application No. PCT/US2009/042514, Korean Intellectual Property Office, dated Nov. 27, 2009.

Jung Hye Lee, Written Opinion for International Patent Application No. PCT/US2009/042514, Korean Intellectual Property Office, dated Nov. 27, 2009.

International Search Report for corresponding International patent application No. PCT/US2008/083532. Feb. 2, 2009.

Written Opinion for corresponding International patent application No. PCT/US2008/083532. Feb. 2, 2009.

Sheppard, N. and Dolly, B. "Rock Drilling—Hybrid Bit Success for Syndax3 Pins." Industrial Diamond Review, Jun. 1993, pp. 309-311.

Tomlinson, P. and Clark, I. "Rock Drilling—Syndax3 Pins—New Concepts in PCD Drilling." Industrial Diamond Review, Mar. 1992, pp. 109-114.

Williams, J. and Thompson, A. "An Analysis of the Performance of PDC Hybrid Drill Bits." SPE/IADC 16117, SPE/IADC Drilling Conference, Mar. 1987, pp. 585-594.

Warren, T. and Sinor L. "PDC Bits: What's Needed to Meet Tomorrow's Challenge." SPE 27978, University of Tulsa Centennial Petroleum Engineering Symposium, Aug. 1994, pp. 207-214.

Smith Services. "Hole Opener—Model 6980 Hole Opener." [retrieved from the Internet on May 7, 2008 using <URL: http://www.siismithservices.com/b_products/product_page.asp?ID=589>].

Mills Machine Company, Inc. "Rotary Hole Openers—Section 8." [retrieved from the Internet on Apr. 27, 2009 using <URL: http://www.millsmachine.com/pages/home_page/mills_catalog/cat_holeopen/cat_holeopen.pdf>].

Ersoy, A. and Waller, M. "Wear characteristics of PDC pin and hybrid core bits in rock drilling." Wear 188, Elsevier Science S.A., Mar. 1995, pp. 150-165.

Sung Joon Lee, International Search Report for International Patent Application No. PCT/US2009/050672, Korean Intellectual Property Office, dated Mar. 3, 2010.

Sung Joon Lee, Written Opinion for International Patent Application No. PCT/US2009/050672, Korean Intellectual Property Office, dated Mar. 3, 2010.

Pessier, R. and Damschen, M., "Hybrid Bits Offer Distinct Advantages in Selected Roller Cone and PDC Bit Applications," IADC/SPE Drilling Conference and Exhibition, Feb. 2-4, 2010, New Orleans.

S.H. Kim, International Search Report for International Patent Application No. PCT/US2009/067969, Korean Intellectual Property Office, dated May 25, 2010.

S.H. Kim, Written Opinion for International Patent Application No. PCT/US2009/067969, Korean Intellectual Property Office, dated May 25, 2010.

R. Buske, C. Rickabaugh, J. Bradford, H. Lukasewich and J. Overstreet. "Performance Paradigm Shift: Drilling Vertical and Directional Sections Through Abrasive Formations with Roller Cone Bits." Society of Petroleum Engineers—SPE 114975, CIPC/SPE Gas Technology Symposium 2008 Joint Conference, Canada, Jun. 16-19, 2008.

Dr. M. Wells, T. Marvel and C. Beuershausen. "Bit Balling Mitigation in PDC Bit Design." International Association of Drilling Contractors/Society of Petroleum Engineers—IADC/SPE 114673, IADC/SPE Asia Pacific Drilling Technology Conference and Exhibition, Indonesia, Aug. 25-27, 2008.
B. George, E. Grayson, R. Lays, F. Felderhoff, M. Doster and M. Holmes. "Significant Cost Savings Achieved Through the Use of PDC Bits in Compressed Air/Foam Applications." Society of Petroleum Engineers—SPE 116118, 2008 SPE Annual Technical Conference and Exhibition, Denver, Colorado, Sep. 21-24, 2008.
Kang, K.H., International Search Report for International Patent Application No. PCT/US2010/033513, Korean Intellectual Property Office, dated Jan. 10, 2011.
Kang, K.H., Written Opinion for International Patent Application No. PCT/US2010/033513, Korean Intellectual Property Office, dated Jan. 10, 2011.
Kang, M.S., International Search Report for International Patent Application No. PCT/US2010/032511, Korean Intellectual Property Office, dated Jan. 17, 2011.
Kang, M.S., Written Opinion for International Patent Application No. PCT/US2010/032511, Korean Intellectual Property Office, dated Jan. 17, 2011.
Choi, J.S., International Search Report for International Patent Application No. PCT/US2010/039100, Korean Intellectual Property Office, dated Jan. 25, 2011.
Choi, J.S., Written Opinion for International Patent Application No. PCT/US2010/039100, Korean Intellectual Property Office, dated Jan. 25, 2011.
Baharlou, S., International Preliminary Report on Patentability, The International Bureau of WIPO, dated Jan. 25, 2011.
Becamel, P., International Preliminary Report on Patentability, dated Jan. 5, 2012, The International Bureau of WIPO, Switzerland.
Georgescu, M., International Search Report for International Patent Application No. PCT/US2010/051019, dated Jun. 6, 2011, European Patent Office.
Georgescu, M., Written Opinion for International Patent Application No. PCT/US2010/051019, dated Jun. 6, 2011, European Patent Office.
Georgescu, M., International Search Report for International Patent Application No. PCT/US2010/051020, dated Jun. 1, 2011, European Patent Office.
Georgescu, M., Written Opinion for International Patent Application No. PCT/US2010/051020, dated Jun. 1, 2011, European Patent Office.
Georgescu, M., International Search Report for International Patent Application No. PCT/US2010/051017, dated Jun. 8, 2011, European Patent Office.
Georgescu, M., Written Opinion for International Patent Application No. PCT/US2010/051017, dated Jun. 8, 2011, European Patent Office.
Georgescu, M., International Search Report for International Patent Application No. PCT/US2010/051014, dated Jun. 9, 2011, European Patent Office.
Georgescu, M., Written Opinion for International Patent Application No. PCT/US2010/051014, dated Jun. 9, 2011, European Patent Office.
Georgescu, M., International Search Report for International Patent Application No. PCT/US2010/050631, dated Jun. 10, 2011, European Patent Office.
Georgescu, M., Written Opinion for International Patent Application No. PCT/US2010/050631, dated Jun. 10, 2011, European Patent Office.

* cited by examiner

-- Prior Art --

HYBRID DRILL BIT WITH HIGH BEARING PIN ANGLES

CROSS REFERENCE TO RELATED APPLICATIONS

Not applicable.

STATEMENT REGARDING FEDERALLY SPONSORED RESEARCH OR DEVELOPMENT

Not applicable.

REFERENCE TO APPENDIX

Not applicable.

BACKGROUND OF THE INVENTION

1. Field of the Invention

The disclosure described herein generally relates to drill bits for use in drilling operations in subterranean formations. More particularly, the disclosure relates to hybrid bits, and the pin angle of rolling cutters in the hybrid bit in conjunction with fixed blades of the hybrid bit.

2. Description of the Related Art

Drill bits are frequently used in the oil and gas exploration and the recovery industry to drill well bores (also referred to as "boreholes") in subterranean earth formations. There are two common classifications of drill bits used in drilling well bores that are known in the art as "fixed blade" drill bits and "roller cone" drill bits. Fixed blade drill bits include polycrystalline diamond compact (PDC) and other drag-type drill bits. These drill bits typically include a bit body having an externally threaded connection at one end for connection to a drill string, and a plurality of cutting blades extending from the opposite end of the bit body. The cutting blades form the cutting surface of the drill bit. Often, a plurality of cutting elements, such as PDC cutters or other materials, which are hard and strong enough to deform and/or cut through earth formations, are attached to or inserted into the blades of the bit, extending from the bit and forming the cutting profile of the bit. This plurality of cutting elements is used to cut through the subterranean formation during drilling operations when the drill bit is rotated by a motor or other rotational input device.

The other type of earth boring drill bit, referred to as a roller cone bit, typically includes a bit body with an externally threaded connection at one end, and a plurality of roller cones (typically three) attached at an offset angle to the other end of the drill bit. These roller cones are able to rotate about bearings, and rotate individually with respect to the bit body.

An exemplary roller cone bit and cutting roller cone are illustrated in FIGS. 1A and 1B and described in U.S. Pat. No. 6,601,661, incorporated herein by reference. The roller cone bit 10 includes a bit body 12 having a longitudinal centerline 8 and having a threaded pin-type connector 14 at its upper end known as a "shank" for coupling the bit body 12 with the lower end of a drill string (not shown). The bit body 12 has generally three downwardly depending legs (two shown as legs 16, 18) with a lubricant compensator 20 provided for each. Nozzles 22 (one shown) are positioned between each of the adjacent legs to dispense drilling fluid during drilling. The drilling fluid is pumped down through the drill string and into a cavity (not shown) in the bit body 12. A roller cone is secured to the lower end of each of the three legs. The three roller cones 24, 25, and 26 are visible in FIG. 1 secured in a rolling relation to the lower ends of the legs of bit body 12.

The roller cone 24 has a cutter body 32 that is typically formed of suitably hardened steel. The cutter body 32 is substantially cone-shaped. A plurality of primary cutting elements 34, 36, 38 extend from the cutter body 32. When the cutter body 32 is rotated upon the spindle 28, the primary cutting elements engage earth within a borehole and crush it. The plurality of cutting elements may be one or a combination of milled steel teeth (called steel-tooth bits), tungsten carbide (or other hard-material) inserts (called insert bits), or a number of other formed and/or shaped cutting elements that are formed of materials having a hardness and strength suitable enough to allow for the deformation and/or cutting through of subterranean formations. In some instances, a hard facing material is applied to the exterior of the cutting elements and/or other portions of the roller cone drill bit, to reduce the wear on the bit during operation and extend its useful working life.

The roller cone 26 is rotatably retained by bearings 27 on a spindle 28 having a spindle base 29 that joins the roller cone leg 18. The spindle 28 has an axis of rotation 6 that is at some angle "$\alpha$", known as a "pin angle". The pin angle is measured between the spindle axis of rotation 6 and a datum plane 7. The datum plane 7 is formed orthogonal to the longitudinal centerline 8 of the bit. The datum plane 7 intersects the spindle axis of rotation 6 near the spindle base 29, as illustrated in FIG. 1A. The plane 7 can be represented pictorially as a horizontal plane when the bit centerline 8 is vertical with the shank oriented upright and the cutters facing downwardly, as seen in FIG. 1A. The spindle base 29 is the region of the junction between the spindle 28 and the roller cone leg 18, and generally is located proximate to the intersection of the rear face 30 of the roller cone 26 and the spindle axis of rotation 6. The pin angle "$\alpha$" is measured in a plane 9 that is orthogonal to the plane 7 and contains the spindle axis of rotation 6. The pin angle is measured in a counterclockwise direction from the datum plane 7 to the spindle axis of rotation 6 starting at the intersection of the plane 7 with the bit centerline 8, when viewed with the spindle 28 oriented to the right of a vertical centerline 8. The pin angle "$\alpha$", as illustrated in FIG. 1A, measures approximately 33 degrees. It should be noted that the axis of rotation 6 may not intersect the bit longitudinal centerline 8, if the bit has offset.

The pin angle from the plane 7 to the axis of rotation 6 of the roller cone can be generally from 33 degrees to 39 degrees, with 33 degrees to 36 degrees being customary. The pin angle is critical to establishing the intermeshing of the roller cones and their cutting elements. Further, the pin angle significantly affects the load on the rolling cone and its spindle for radial and thrust loads. Generally, a smaller pin angle, such as 33 degrees, will be used for softer cutting formations, where a smaller pin angle allows the cutting elements to have a greater projection outwardly for more engagement with the formation. A larger pin angle, such as 36 degrees, will generally be used for harder cutting formations, where the cutting elements have less projection into the formation. The pin angle further affects and is affected by roller cone bearing size, the number of rolling cones, projection length and shape of the cutting elements on the rolling cone, leg strength, roller cone diameter, shape of the rolling cone, and other factors. The pin angle is empirically picked and has been standardized between the above referenced angles of 33 degrees to 39 degrees with 33 degrees to 36 degrees being the most common. A small change can yield significant differences in the roller cone performance, and some pin angles are determined in increments of less than 1 degree.

These general classes of earth boring bits have limitations, particularly with the bit life and the types of subterranean formations through which they can drill. Fixed blade bits using PDC cutting elements, and therefore known as "PDC bits", usually can be used with success in soft to medium-hard formations. Hard and/or abrasive formations are generally considered more challenging for PDC bits in that their use in such formations results in excessive wear and shortened working life. For example, mudstone and siltstone have been drilled well; however, sandstones, particularly if coarse-grained and cemented, are very difficult to drill economically and are highly destructive to fixed blade drill bits. [See, for example, Feenstra, R., et al., "Status of Polycrystalline-Diamond-Compact Bits: Part 1—Development" and "Part 2—Applications", *Journal of Petroleum Technology*, Vol. 40 (7), pp. 675-684 and 817-856 (1988).] Success is fully dependent on a good match between the bit, the formation to be drilled, and the operating conditions. Experience has shown that for fixed blade bits such as PDC bits, the type of mud, the bit hydraulics, and bit design may affect bit performance.

Repeated experience shows that a preferred practice is to develop the best bit design for a particular field rather than to select one from a range. Increased aggressiveness in earth-boring bits is not always desirable, because of the increase torque requirements that are generally associated with it. The ability to design and/or tailor a bit to a particular subterranean operation or application can be an invaluable tool for the bit designer. Thus, in recent years, attempts have been made to develop earth-boring drill bits that use a combination of one or more rolling cutters and one or more fixed blades having PDC or similarly abrasive cutting elements formed or bonded thereon. Some of these combination type bits are referred to as "hybrid drill bits".

One previously described hybrid drill bit is disclosed in U.S. Pat. No. 4,343,371, "wherein a pair of opposing extended nozzle drag bit legs are positioned with a pair of opposed tungsten carbide roller cones. The extended nozzle face nearest the hole bottom has a multiplicity of diamond inserts mounted therein. The diamond inserts are strategically positioned to remove the ridges between the kerf rows in the hole bottom formed by the inserts in the roller cones. A cross section of the pilot pin and journal is not shown in the above patent, but is typically the same as a roller cone bit.

The typical practice heretofore has been to combine the fixed blades with a modified roller cone (herein a "rolling cutter") using the same pin angles of a roller cone drill bit. The additional space used by the fixed blades requires that the size of the roller cones be reduced to fit with the blades. The size of the roller cones on a hybrid bit will generally be smaller than the cones on a roller cone bit of the same diameter. The reduced cone size may result in fewer cutting elements, smaller diameter cutting elements, reduced bearing diameter and length, and other compromises. Some unique drill bits vary from the standard pin angles, but appear to be limited to single fixed blade and single rolling cutters. These somewhat rare and special purpose drill bits are not constrained by the interrelationships of multiple fixed blades and multiple rolling cutters. Thus, the teachings of such unique drill bits are not transferable to a drill bit with multiple fixed blades and multiple rolling cutters.

There remains a need for an improved hybrid bit that can better optimize the interrelationships between the fixed blades and rolling cutters.

BRIEF SUMMARY OF THE INVENTION

The invention disclosed and taught herein is directed to an improved hybrid drill bit having at least two rolling cutters, each rotatable around an axis of rotation, at least one of the rolling cutters having a high pin angle, and at least one fixed blade. The increase in the pin angle can encompass pin angles above 39 degrees to less than 393 degrees. In at least one embodiment, the improved drill bit expands the capabilities of a hybrid bit to allow the rolling cutters to engage a shoulder portion and/or gage portion of the bit profile and assist the fixed blade(s) in these areas. The pin angle can be increased to 90 degrees to a vertical position. At a pin angle above 90 degrees and below 270 degrees, the rolling cutter axis of rotation faces outwardly, away from the drill bit centerline. Above 270 degrees to below 360 degrees, the axis of rotation of the rolling cutter faces inward but in a direction away from the end of the drill bit. Above 360 degrees but less than 393 degrees, the axis of rotation faces inward and toward the end of the drill bit but in a shallower pin angle than heretofore used by hybrid bits.

The disclosure provides a hybrid drill bit for use in drilling through subterranean formations, the hybrid drill bit comprising: a shank disposed about a longitudinal centerline and adapted to be coupled to a drilling string; at least one fixed blade extending in the axial direction downwardly and coupled to the shank; at least one fixed cutting element arranged on the fixed blade; at least two rolling cutter legs coupled to the shank, each comprising an spindle having an axis of rotation; and at least two rolling cutters coupled to the rolling cutter legs distally from the shank and adapted to rotate about the axis of rotation at a pin angle greater than 39 degrees and less than 393 degrees.

The disclosure also provides a hybrid drill bit for use in drilling through subterranean formations, the hybrid drill bit comprising: a shank disposed about a longitudinal centerline and adapted to be coupled to a drilling string; at least one fixed blade extending in the axial direction downwardly and coupled to the shank; at least one fixed cutting element arranged on the fixed blade; at least two rolling cutter legs coupled to the shank, each comprising an spindle having an axis of rotation, the axis of rotation being at a pin angle greater than 39 degrees and less than 393 degrees.

BRIEF DESCRIPTION OF THE SEVERAL VIEWS OF THE DRAWINGS

The following figures form part of the present specification and are included to further demonstrate certain aspects of the present invention. The invention may be better understood by reference to one or more of these figures in combination with the detailed description of specific embodiments presented herein.

Figure 1A:
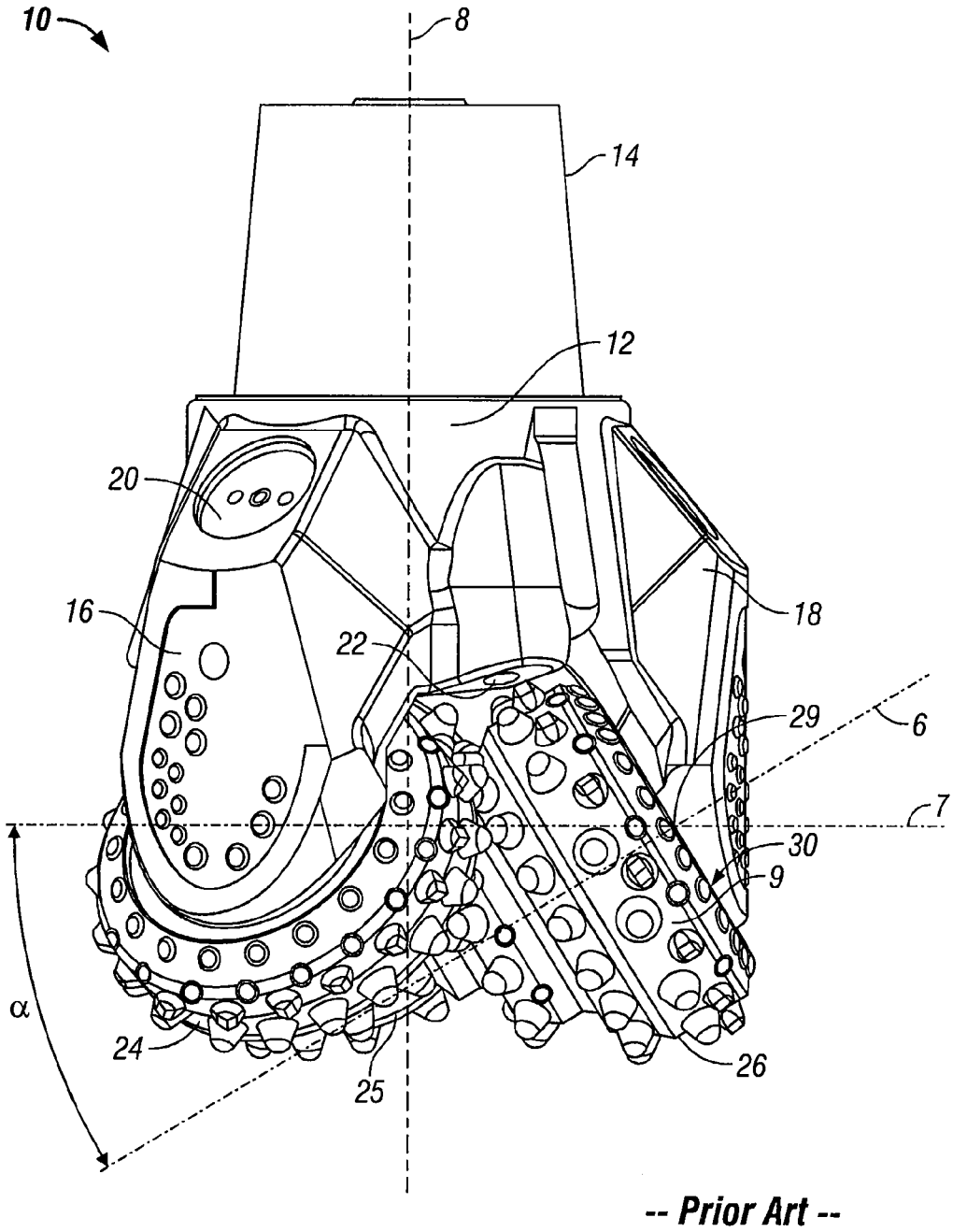
FIG. 1A illustrates a schematic side view of a typical roller cone bit.
Figure 1B:
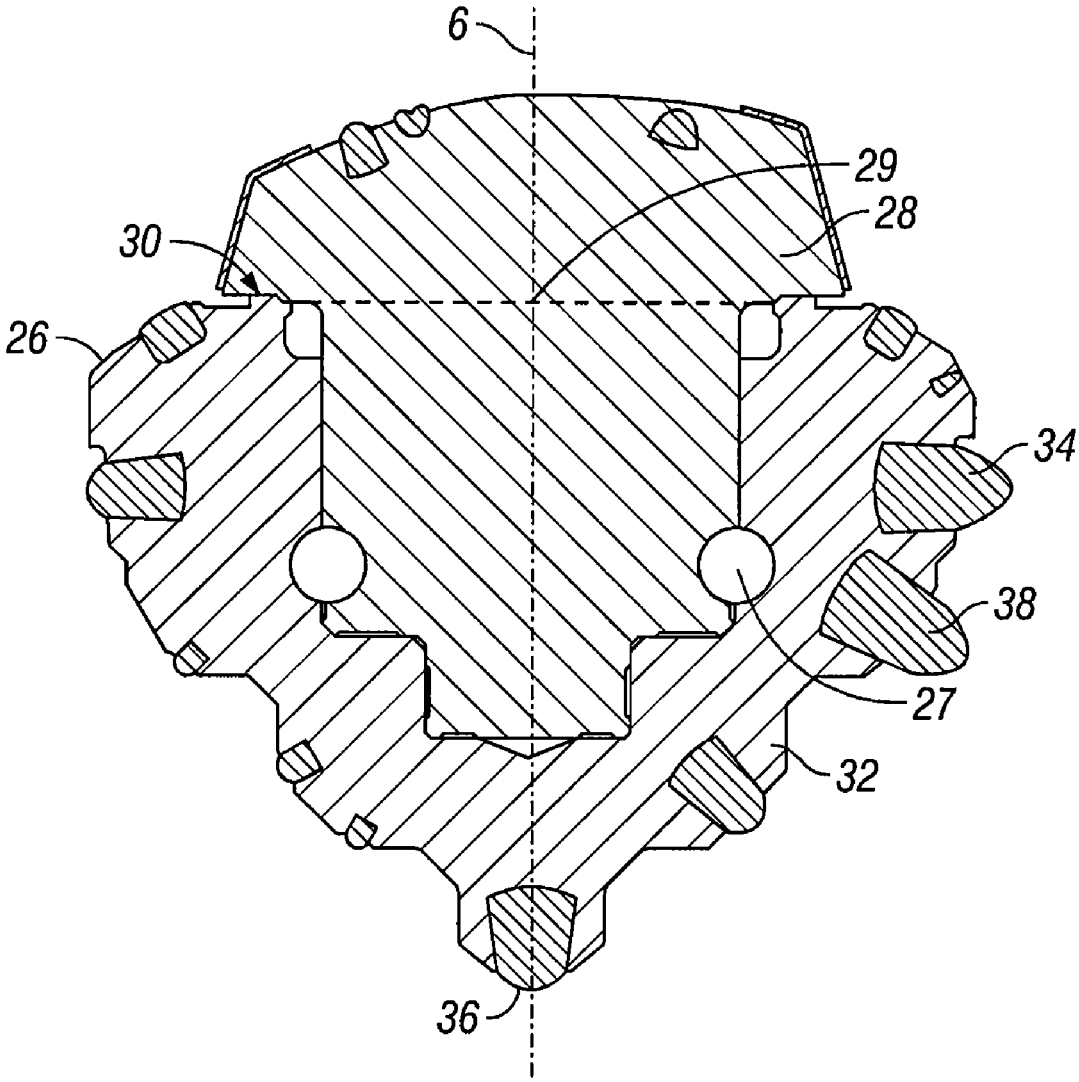
FIG. 1B illustrates a schematic cross sectional side view of a typical roller cone.

While the invention disclosed herein is susceptible to various modifications and alternative forms, only a few specific embodiments have been shown by way of example in the drawings and are described in detail below. The figures and detailed descriptions of these specific embodiments are not intended to limit the breadth or scope of the inventive concepts or the appended claims in any manner. Rather, the figures and detailed written descriptions are provided to illustrate the inventive concepts to a person of ordinary skill in the art and to enable such person to make and use the inventive concepts.

DETAILED DESCRIPTION

The Figures described above and the written description of specific structures and functions below are not presented to limit the scope of what Applicants have invented or the scope of the appended claims. Rather, the Figures and written description are provided to teach any person skilled in the art to make and use the inventions for which patent protection is sought. Those skilled in the art will appreciate that not all features of a commercial embodiment of the inventions are described or shown for the sake of clarity and understanding. Persons of skill in this art will also appreciate that the development of an actual commercial embodiment incorporating aspects of the present inventions will require numerous implementation-specific decisions to achieve the developer's ultimate goal for the commercial embodiment. Such implementation-specific decisions may include, and likely are not limited to, compliance with system-related, business-related, government-related and other constraints, which may vary by specific implementation, location and from time to time. While a developer's efforts might be complex and time-consuming in an absolute sense, such efforts would be, nevertheless, a routine undertaking for those of skill this art having benefit of this disclosure. It must be understood that the inventions disclosed and taught herein are susceptible to numerous and various modifications and alternative forms. Lastly, the use of a singular term, such as, but not limited to, "a," is not intended as limiting of the number of items. Also, the use of relational terms, such as, but not limited to, "top," "bottom," "left," "right," "upper," "lower," "down," "up," "side," and the like are used in the written description for clarity in specific reference to the Figures and are not intended to limit the scope of the invention or the appended claims. The terms "couple," "coupled," "coupling," "coupler," and like terms are used broadly herein and may include any method or device for securing, binding, bonding, fastening, attaching, joining, inserting therein, forming thereon or therein, communicating, or otherwise associating, for example, mechanically, magnetically, electrically, chemically, directly or indirectly with intermediate elements, one or more pieces of members together and may further include without limitation integrally forming one functional member with another in a unity fashion. The coupling may occur in any direction, including rotationally.

Figure 2A:
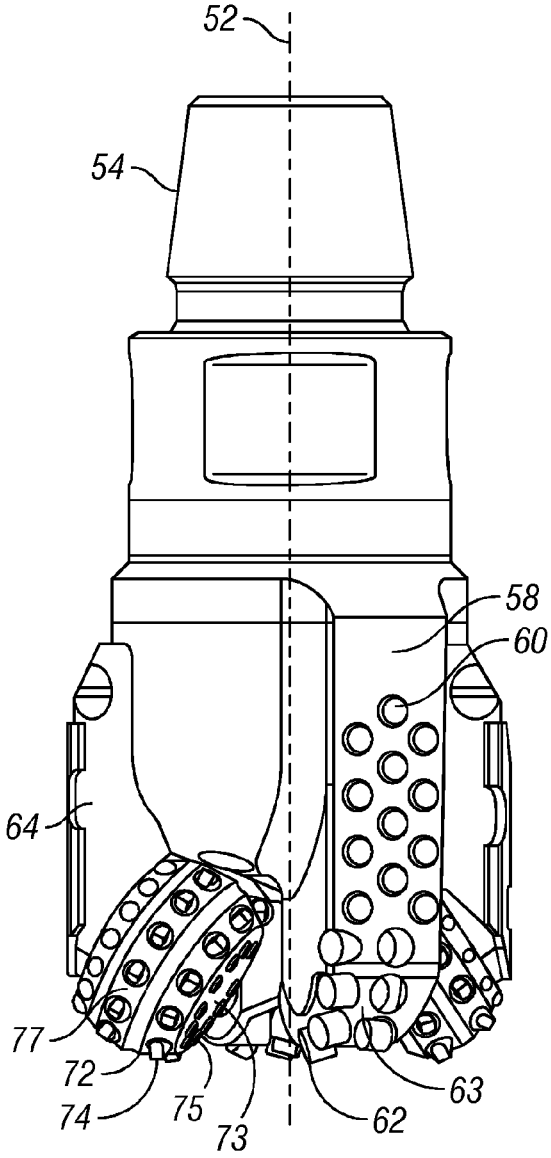
FIG. 2A illustrates a schematic side view of an exemplary hybrid drill bit.
Figure 2B:
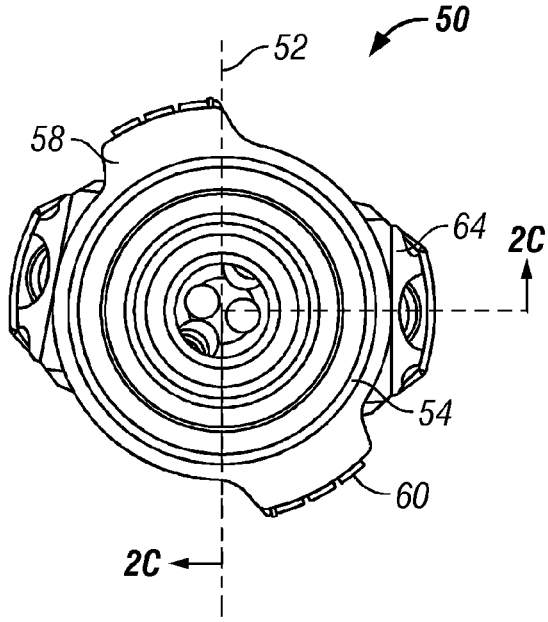
FIG. 2B illustrates a schematic top view of the exemplary hybrid bit of FIG. 2A.
Figure 2C:
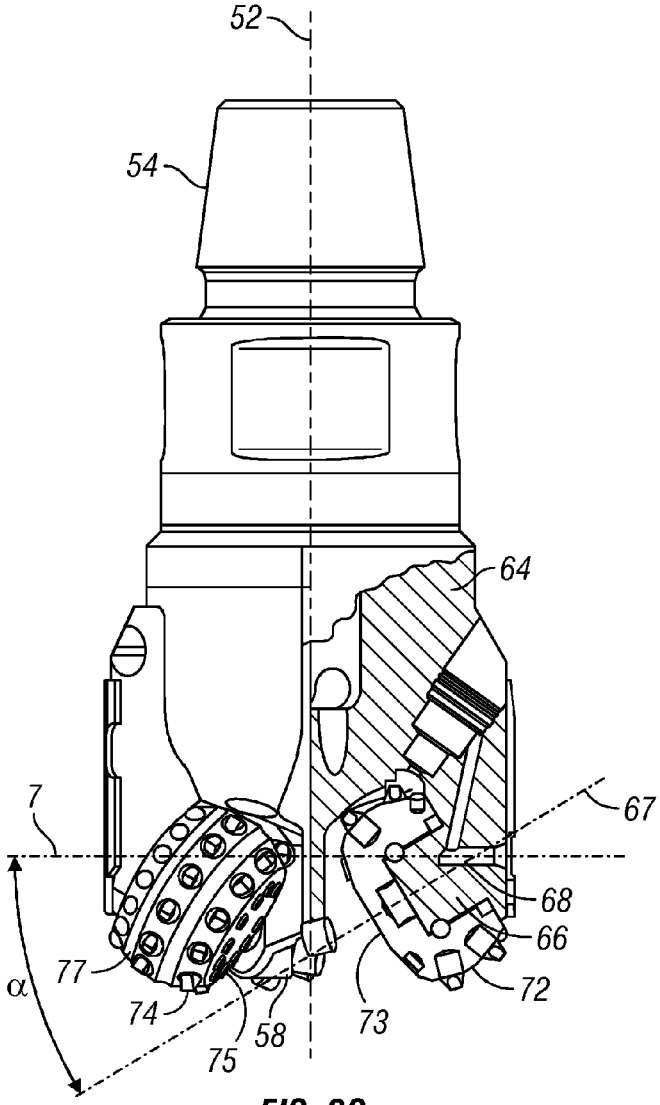
FIG. 2C illustrates a schematic partial cross sectional side view of the exemplary hybrid drill bit of FIG. 2A.
Figure 2D:
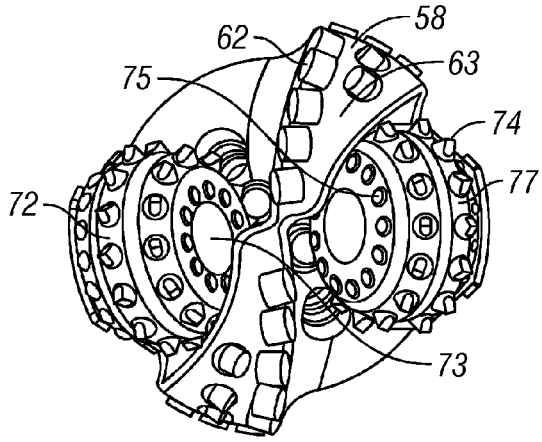
FIG. 2D illustrates a schematic bottom view of the exemplary hybrid drill bit of FIG. 2A.

FIG. 2A illustrates a schematic side view of an exemplary hybrid drill bit. FIG. 2B illustrates a schematic top view of the exemplary hybrid bit bit of FIG. 2A. FIG. 2C illustrates a schematic partial cross sectional side view of the exemplary hybrid drill bit of FIG. 2A. FIG. 2D illustrates a schematic bottom view of the exemplary hybrid drill bit of FIG. 2A. The figures will be described in conjunction with each other. The hybrid drill bit 50 has a longitudinal centerline 52 that defines an axial center of the hybrid drill bit about which the drill bit can rotate. A shank 54 is formed on one end of the hybrid drill bit and is designed to be coupled to a drill string of tubular material (not shown) with threads according to standards promulgated for example by the American Petroleum Institute (API).

At least one fixed blade 58 (for example and without limitation, two fixed blades as shown) extends downwardly from the shank 54 relative to a general orientation of the bit inside a borehole. A plurality of fixed blade cutting elements 60, 62 are arranged and secured to a surface 63 on each of the fixed blades 58, such as at the leading edges of the hybrid drill bit relative to the direction of rotation. Generally, the fixed blade cutting elements 60, 62 comprise a polycrystalline diamond (PCD) layer or table on a rotationally leading face of a supporting substrate, the diamond layer or table providing a cutting face having a cutting edge at a periphery thereof for engaging the formation. The term PCD is used broadly and includes other materials, such as thermally stable polycrystalline diamond (TSP) wafers or tables mounted on tungsten carbide substrates, and other, similar superabrasive or superhard materials, such as cubic boron nitride and diamond-like carbon. Fixed-blade cutting elements 60, 62 may be brazed or otherwise secured in recesses or "pockets" on each fixed blade 58 so that their peripheral or cutting edges on cutting faces are presented to the formation.

The hybrid drill bit 50 further includes at least two rolling cutter legs 64 and rolling cutters 72 coupled to such legs. The rolling cutter legs 64 extend downwardly from the shank 54 relative to a general orientation of the bit inside a borehole. Each of the rolling cutter legs 64 includes a spindle, such as a spindle 66*a* for a rolling cutter 72*a* shown in FIG. 3C, coupled at spindle base 68 to the legs' distal end, where the spindle is generally nominated by the element number 66. The spindle 66 has an axis of rotation 67 about which the spindle is generally symmetrically formed and the rolling cutter rotates, as described below. The axis of rotation 67 is generally disposed at a pin angle "α" of 33 degrees to 39 degrees based on the teachings and industry standard practices of roller cone drill bits discussed above, where the pin angle is measured starting at the plane 7 and ending at the axis of rotation 67 of the spindle 66, as the pin angle has previously been described in reference to FIG. 1A. In at least one embodiment, the axis of rotation 67 can intersect the longitudinal centerline 52. In other embodiments, the axis of rotation can be skewed to the side of the longitudinal centerline to create a sliding effect on the cutting elements as the rolling cutter rotates around the axis of rotation.

A rolling cutter 72 is generally coupled to each spindle 66. The rolling cutter 72 generally has an end 73 that in some embodiments can be truncated compared to a typical roller cone bit illustrated in FIG. 2. The rolling cutter 72 is adapted to rotate around the spindle 66 when the hybrid drill bit 50 is being rotated by the drill string through the shank 54. Generally, a plurality of cutting elements 74, 75 is coupled to a surface 77 of the rolling cutter 72. At least some of the cutting elements are generally arranged on the rolling cutter 72 in a circumferential row thereabout. A minimal distance between the cutting elements will vary according to the application and bit size, and may vary from rolling cutter to rolling cutter, and/or cutting element to cutting element. Some cutting elements can be arranged "randomly" on the surface of the rolling cutter. The cutting elements can include tungsten carbide inserts, secured by interference fit into bores in the surface of the rolling cutter, milled- or steel-tooth cutting elements having hard faced cutting elements integrally formed with and protruding from the surface of the rolling cutter, and other types of cutting elements. The cutting elements may also be formed of, or coated with, superabrasive or super-hard materials such as polycrystalline diamond, cubic boron nitride, and the like. The cutting elements may be chisel-shaped as shown, conical, round, or ovoid, or other shapes and combinations of shapes depending upon the application.

One or more sealed or unsealed bearings (not shown) can help secure the rolling cutter 72 to the spindle 66 and/or provide a contact length along the axis of rotation that can assist the rolling cutter in being rotated about the spindle to support radial and thrust loadings. The rolling cutter 72 generally includes one or more seals (not shown) disposed between the spindle 66 and an inside cavity of the rolling cutter, such as elastomeric seals and metal face seals. Other features of the hybrid drill bit such as back up cutters, wear resistant surfaces, nozzles that are used to direct drilling fluids, junk slots that provides a clearance for cuttings and drilling fluid, and other generally accepted features of a drill bit are deemed within the knowledge of those with ordinary skill in the art and do not need further description.

Having described the general aspects of the hybrid drill bit, the focus returns to the spindle and the pin angle.

Figure 3A:
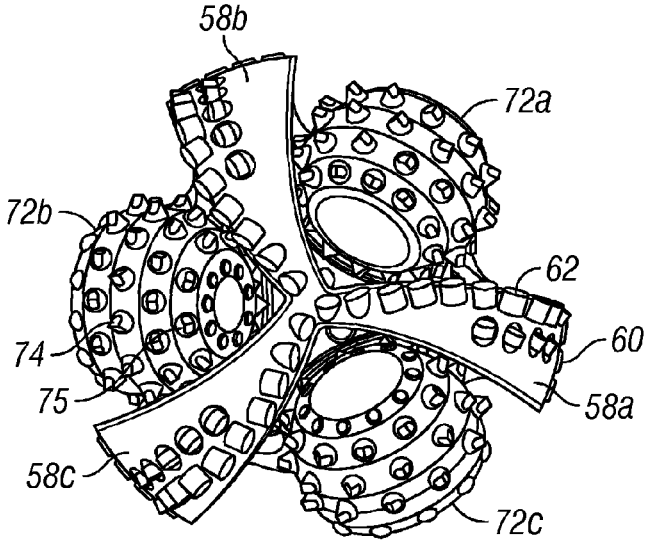
FIG. 3A illustrates a schematic bottom view of an exemplary hybrid drill bit.
Figure 3B:
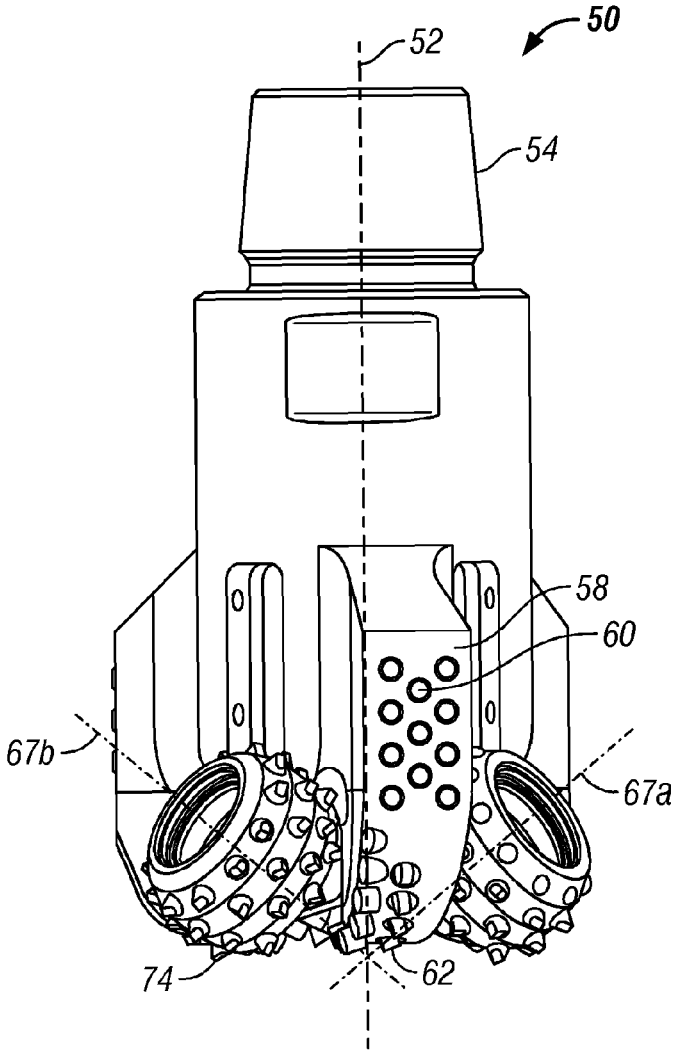
FIG. 3B illustrates a schematic side view of an exemplary hybrid drill bit.
Figure 3C:
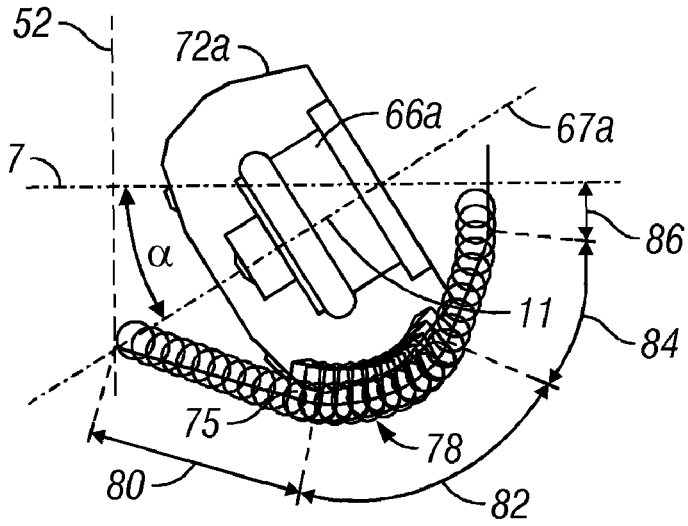
FIG. 3C illustrates a schematic cutting profile with a cross sectional side view of an exemplary spindle having a pin angle.

FIG. 3A illustrates a schematic bottom view of an exemplary hybrid drill bit. FIG. 3B illustrates a schematic side view of an exemplary hybrid drill bit. FIG. 3C illustrates a schematic cutting profile with a cross sectional side view of an exemplary spindle having a pin angle. The figures will be described in conjunction with each other.

The exemplary hybrid bit 50 includes a shank 54 and multiple fixed blades 58*a*, 58*b*, 58*c* (generally "58") that are interrelated to multiple rolling cutters 72*a*, 72*b*, 72*c* (generally "72"). The rolling cutters 72 are each rotationally coupled to a spindle, such as spindle 66*a*, and can rotate about their respective axes of rotation 67*a*, 67*b* at respective pin angles "α". The cutting elements 74, 75 of the rolling cutter 72 crush and pre- or partially fracture subterranean materials in a formation in the highly stressed portions, assisting the cutting elements 60, 62 of the fixed blade 58. As shown in FIG. 3C for a hybrid drill bit, the cutting elements 62 of the fixed blade 58 and the cutting elements 74, 75 of the rolling cutter 72 combine to define a congruent cutting face in a hybrid drill bit cutting profile 78.

The cutting profile 78 of the hybrid bit can be divided into several regions: a generally linear cutter region 80 extending radially outward from the longitudinal axis 52; a nose region 82 that is curved at a selected radius and defines the leading portion of the bit; and a shoulder region 84 that is also curved at a selected radius and connects the nose region to a gage region 86 of the bit. The selected radii in the nose region 82 and shoulder region 84 may be the same (a single radius) or different (a compound radius). The fixed blade 58 configuration primarily controls the cutting profile 78 through the cutting effects of the fixed blade cutting elements. The cutting effects of the rolling cutter can be combined with the cutting effects of the fixed blade to assist the fixed blade primarily in the nose region 82, and partially in the shoulder region 84. The fixed blade cutting elements 60 can ream out the borehole wall in the gage region 86.

The pin angle, along with other factors such as length and placement of the cutting elements and rolling cutter diameter, can significantly affect the cutting profile and interrelationships with the fixed blade cutting elements. It is known to the inventors that pin angles between 33 and 36 degrees have been used for hybrid bits with multiple rolling cutters and at least one fixed blade disposed between the rolling cutters, given the historical usage of pin angles between 33 and 39 degrees for roller cone drill bits having multiple roller cones.

However, with hybrid bits having multiple rolling cutters, the inventors have realized that other pin angles can be used that are normally constrained to between about 33 degrees to 39 degrees based on decades of determination and design of roller cone bits. While the industry has widely accepted such roller cone bit constraints as applicable to hybrid bits with multiple rolling cutters and limited the pin angles in the hybrid bits, the inventors have realized that the hybrid bits can be modified to nonconventional pin angles that outside the normal range of accepted practice for roller cone bits having multiple roller cones.

In at least one embodiment of the hybrid bit (described below in various figures), the higher pin angles on the rolling cutters with the associated cutting elements can help assist the fixed blade cutting elements. This protection of the fixed blade cutting elements by adjusting the pin angles in the hybrid bits of the present invention are beyond those pin angles that have been used for roller cone bits due to the interrelationships between the fixed blades and the rolling cutters. The higher pin angles can be especially advantageous in the nose, shoulder, and gage sections of the cutting profile of the cutting elements that carry a heavy burden with excessive wear in drilling the hole.

The remaining figures illustrate various unconventional pin angles for a hybrid bit having multiple rolling cones and at least one fixed blade, often multiple fixed blades. The embodiments are merely exemplary embodiments. Other angles, other quantities of fixed blades and/or rolling cutters, and other variations can be made, so that the invention is not limited to any particle examples illustrated herein.

Figure 4A:
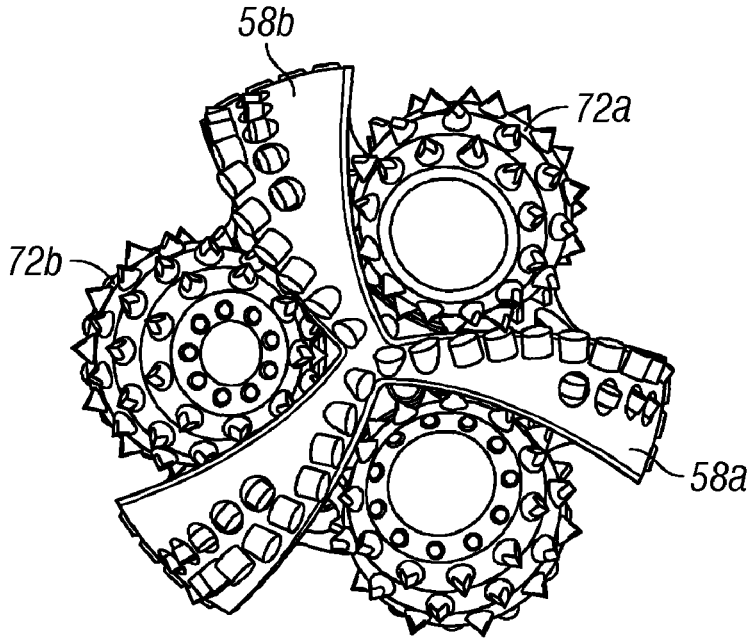
FIG. 4A illustrates a schematic bottom view of another exemplary hybrid drill bit.
Figure 4B:
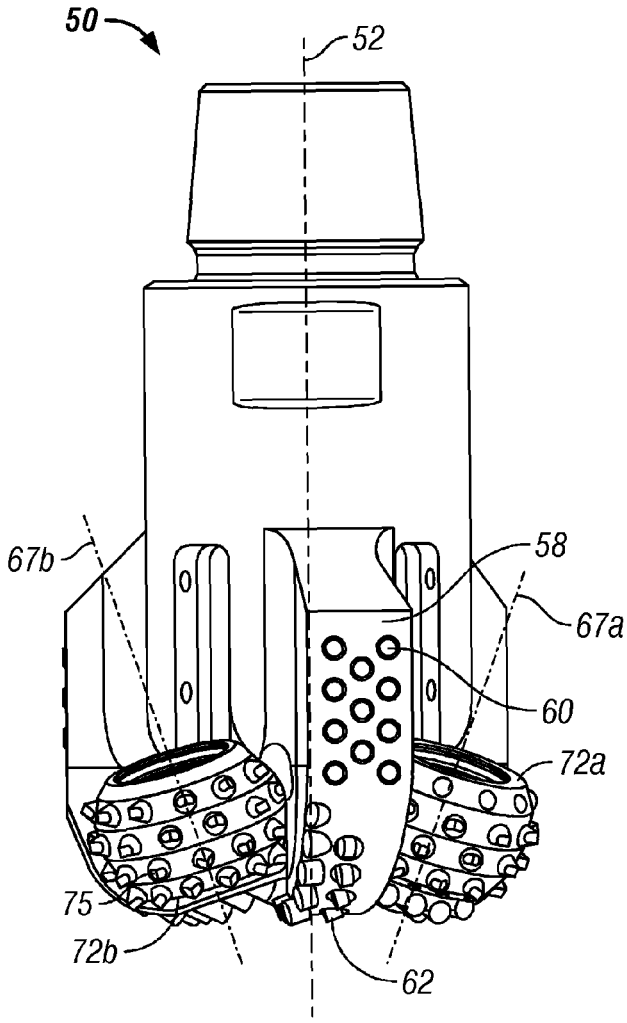
FIG. 4B illustrates a schematic side view of an exemplary hybrid drill bit.
Figure 4C:
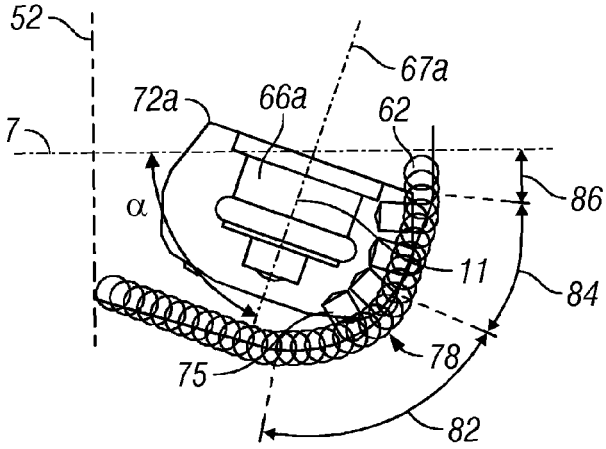
FIG. 4C illustrates a schematic cutting profile with a cross sectional side view of an exemplary spindle having a high pin angle.

FIG. 4A illustrates a schematic bottom view of another exemplary hybrid drill bit. FIG. 4B illustrates a schematic side view of an exemplary hybrid drill bit. FIG. 4C illustrates a schematic cutting profile with a cross sectional side view of an exemplary spindle having a high pin angle. The figures will be described in conjunction with each other.

FIGS. 4A-4C illustrate an embodiment having a pin angle of approximately 70 degrees. The hybrid bit 50 includes multiple fixed blades 58*a*, 58*b* (generally "58") that are interrelated to multiple rolling cutters 72*a*, 72*b* (generally "72"). The rolling cutters 72 are each rotationally coupled to a spindle, such as spindle 66*a*, and can rotate about their respective axes of rotation 67*a*, 67*b* at respective pin angles "α". For the embodiment shown in FIGS. 4A-4C, the pin angle "α" for rolling cutter 72*a* is approximately 70 degrees.

The cutting profile 78 of the hybrid bit in FIG. 4C is similar to the cutting profile of the hybrid bit in FIG. 3C, primarily based on the configuration of the fixed blade 58. However, the effects of the fixed blade cutting elements and cutting elements of the rolling cutter can be combined primarily in the shoulder region 84, and partially combined in the nose region 82 in a different way due to the high pin angle of the rolling cutter. This variance in combined effects of the nose and shoulder regions between FIG. 4C and FIG. 3C is caused by the different and nonconventional pin angle "α" of approximately 70 degrees. This unconventional pin angle allows the rolling cutters 72 to assist the fixed cutters 62 more in at least the shoulder region of the cutting profile.

The normal constraints of having a high pin angle such as spindle and leg strength, cutting profile, cutting element life, and bearing life of the rolling cutters are interrelated to the fixed blades and their cutting elements and design. By coordinating the fixed blade cutting elements with the rolling cutters at high pin angles, the counteracting effects can be optimized for given purposes. Such customization is within the capability of those with ordinary skill in the art, such as oil field drilling bit design engineers, given the teachings and information provided herein.

Figure 5A:
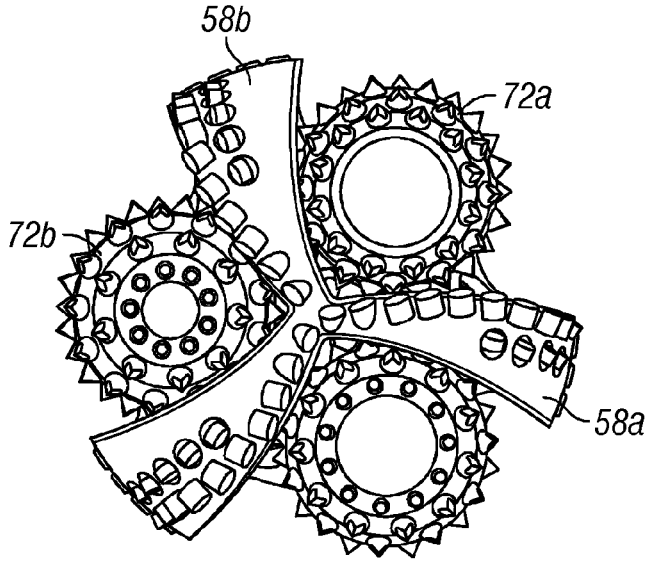
FIG. 5A illustrates a schematic bottom view of another exemplary hybrid drill bit.
Figure 5B:
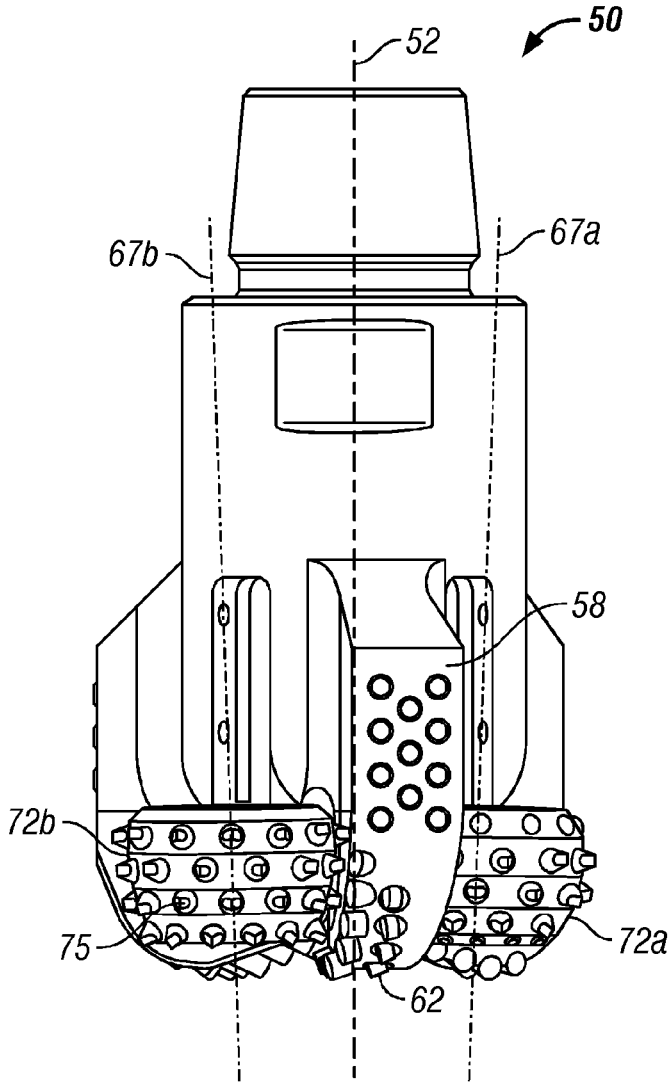
FIG. 5B illustrates a schematic side view of an exemplary hybrid drill bit.
Figure 5C:
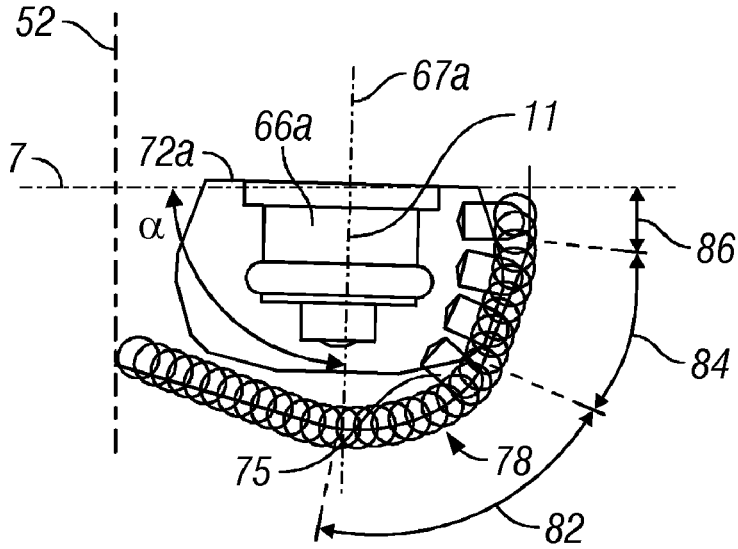
FIG. 5C illustrates a schematic cutting profile with a cross sectional side view of an exemplary spindle having a high pin angle.

FIG. 5A illustrates a schematic bottom view of another exemplary hybrid drill bit. FIG. 5B illustrates a schematic side view of an exemplary hybrid drill bit. FIG. 5C illustrates a schematic cutting profile with a cross sectional side view of an exemplary spindle having a high pin angle. The figures will be described in conjunction with each other.

FIGS. 5A-5C illustrate an embodiment having a pin angle of approximately 88 degrees. The hybrid bit 50 includes multiple fixed blades 58*a*, 58*b* (generally "58") that are interrelated to multiple rolling cutters 72*a*, 72*b* (generally "72"). The rolling cutters 72 are each rotationally coupled to a spindle, such as spindle 66*a*, and can rotate about their respective axes of rotation 67*a*, 67*b* at respective pin angles "α". For the embodiment shown in FIGS. 4A-4C, the pin angle "α" for rolling cutter 72*a* is approximately 88 degrees.

The cutting profile 78 of the hybrid bit in FIG. 5C is similar to the cutting profile of the hybrid bit in FIG. 3C and FIG. 4C, primarily based on the configuration of the fixed blade 58. However, the effects of the fixed blade cutting elements and cutting elements of the rolling cutter can be combined in the shoulder region 84 and in the gage region 86 in a different way due to the high pin angle of the rolling cutter. This variance in combined effects of the shoulder and gage regions between FIG. 5C and FIG. 3C is caused by the different and nonconventional pin angle "a" of approximately 88 degrees. This unconventional pin angle allows the rolling cutters 72 to assist the fixed cutters 62 more in the shoulder and gage regions of the cutting profile.

One exemplary range of pin angles "α" is greater than 39 degrees and less than 90 degrees, in which the spindle 66 is disposed inwardly toward the centerline 52 and downwardly toward a distal end of the drill bit from the shank 54, as viewed from the orientation in FIG. 5C. At a pin angle of 90 degrees, the spindle is disposed downwardly and parallel to the centerline 52.

Figure 6A:
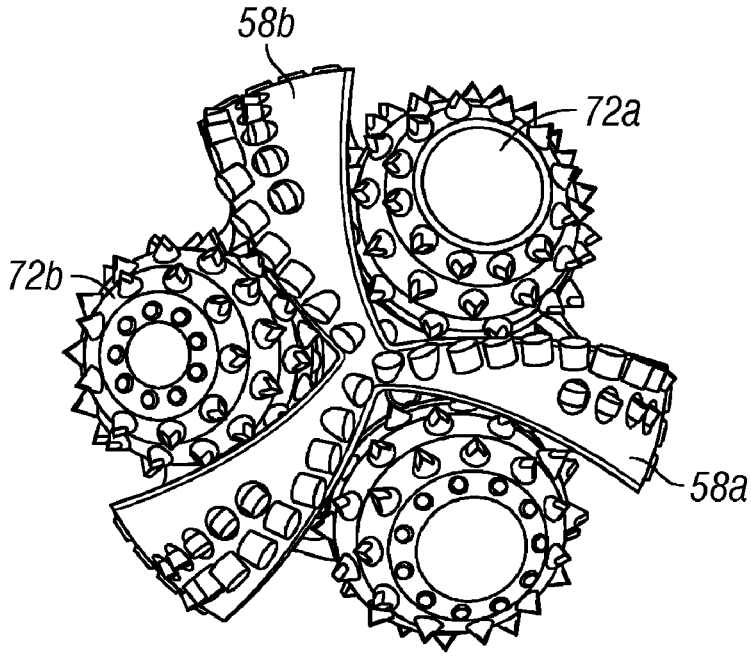
FIG. 6A illustrates a schematic bottom view of another exemplary hybrid drill bit.
Figure 6B:
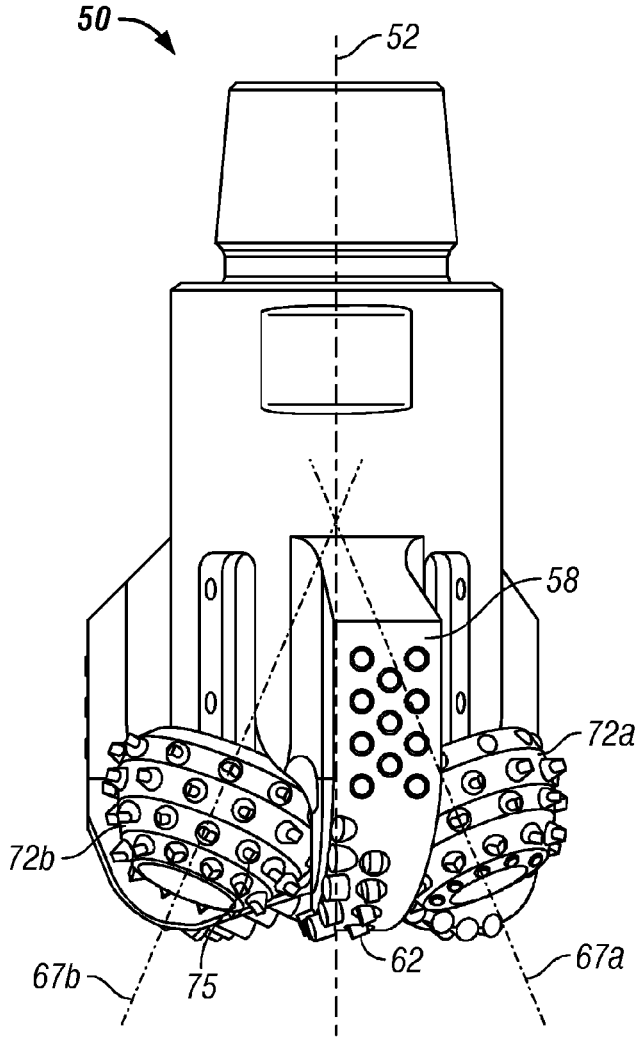
FIG. 6B illustrates a schematic side view of an exemplary hybrid drill bit.
Figure 6C:
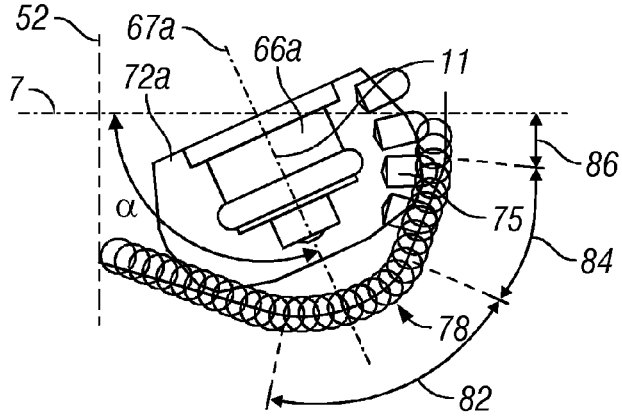
FIG. 6C illustrates a schematic cutting profile with a cross sectional side view of an exemplary spindle having a high pin angle.

FIG. 6A illustrates a schematic bottom view of another exemplary hybrid drill bit. FIG. 6B illustrates a schematic side view of an exemplary hybrid drill bit. FIG. 6C illustrates a schematic cutting profile with a cross sectional side view of an exemplary spindle having a high pin angle. The figures will be described in conjunction with each other.

FIGS. 6A-6C illustrate an embodiment having a pin angle of approximately 115 degrees. The hybrid bit 50 includes multiple fixed blades 58*a*, 58*b* (generally "58") that are interrelated to multiple rolling cutters 72*a*, 72*b* (generally "72"). The rolling cutters 72 are each rotationally coupled to a spindle, such as spindle 66*a*, and can rotate about their respective axes of rotation 67*a*, 67*b* at respective pin angles "α". For the embodiment shown in FIGS. 4A-4C, the pin angle "α" for rolling cutter 72*a* is approximately 115 degrees.

The cutting profile 78 of the hybrid bit in FIG. 6C is similar to the cutting profile of the hybrid bit in FIGS. 3C, 4C, and 5C, primarily based on the configuration of the fixed blade 58. However, the effects of the fixed blade cutting elements and cutting elements of the rolling cutter can be combined primarily in the gage region 86, and partially combined in the shoulder region 84. This variance in combined effects of the shoulder and gage regions between FIG. 6C and FIG. 3C is caused by the different and nonconventional pin angle "α" of approximately 115 degrees. This unconventional pin angle allows the rolling cutters 72 to assist the fixed cutters 62 more in the gage region of the cutting profile.

For pin angles greater than 90 degrees to less than 180 degrees, the spindle 66*a* is disposed outwardly away from the centerline 52 of the drill bit 50 and downwardly toward a distal end of the drill bit from the shank 54, as viewed from the orientation in FIG. 6C. For a pin angle of 180 degrees, the spindle 66*a* is disposed outwardly away from the centerline 52 and orthogonal to the centerline 52. For pin angles greater than 180 degrees and less than 270 degrees, the spindle 66*a* is disposed outwardly away from the centerline 52 of the drill bit 50 and upwardly toward the shank 54. For a pin angle of 270 degrees, the spindle 66*a* is disposed upwardly and parallel to the centerline 52. For pin angles greater than 270 to less than 360, the spindle 66*a* is disposed inwardly toward the centerline 52 and upwardly toward the shank 54. For a pin angle of 360 degrees, the spindle 66*a* is disposed inwardly toward the centerline 52 and orthogonal to the centerline 52. For pin angles greater than 360 degrees to less than 393 degrees, the spindle is disposed inwardly toward the centerline 52 and downward toward a distal end of the drill bit from the shank 54.

The exemplary and nonlimiting angles referenced herein are shown as exemplary whole numbers. Any angle between the ranges given, inclusive, can be used and is included within the scope of the claims. For example, angles greater than 39 degrees and less than 90 degrees, can include angles of 40, 41, 42, . . . 87, 88, and 89 degrees. Further, the pin angles of the present invention described herein are not limited to whole numbers, but rather can include portions of whole numbers, such as fractional and decimal portions. For example and without limitation, between the angles of 40 and 41 degrees, the angles can include angles of 40.1, 40.2 degrees and so forth, as well as 40.11, 40.12 degrees and so forth, and 40½ degrees, 40¼ degrees and so forth. Angles of at least 90 degrees and less than 270 degrees can include angles of 90, 91, 92, . . . 267, 268, and 269 degrees and any portions thereof. Angles of at least 270 degrees and less than 360 degrees can include angles of 270, 271, 272, . . . 357, 358, and 359 degrees and any portions thereof. Angles of at least 360 degrees and less than 393 degrees can include angles of 360, 361, 362, . . . 390, 391, and 392 degrees and any portions thereof.

Other and further embodiments utilizing one or more aspects of the inventions described above can be devised without departing from the spirit of the invention. For example, one or more of the rolling cutters could individually have a pin angle that is different from a pin angle of another rolling cutter on the hybrid bit. Further, the various methods and embodiments of the hybrid drill bit can be included in combination with each other to produce variations of the disclosed methods and embodiments. Discussion of singular elements can include plural elements and vice-versa.

The order of any steps explicitly or implicitly disclosed herein can occur in a variety of sequences unless otherwise specifically limited. The various steps described herein can be combined with other steps, interlineated with the stated steps, and/or split into multiple steps. Similarly, elements have been described functionally and can be embodied as separate components or can be combined into components having multiple functions.

The invention has been described in the context of advantageous and other embodiments and not every embodiment of the invention has been described. Modifications and alterations to the described embodiments are available to those of ordinary skill in the art. The disclosed and undisclosed embodiments are not intended to limit or restrict the scope or applicability of the invention conceived of by the Applicants, but rather, in conformity with the patent laws, Applicants intend to fully protect all such modifications and improvements that come within the scope or range of equivalent of the following claims.

What is claimed is:

1. A hybrid drill bit for use in drilling through subterranean formations, the hybrid drill bit comprising:

a shank disposed about a longitudinal centerline and adapted to be coupled to a drilling string;

at least one fixed blade extending in an axial direction downwardly and coupled to the shank;

at least one fixed cutting element arranged on the fixed blade;

at least two rolling cutter legs coupled to the shank, each comprising a spindle having a respective spindle axis of rotation; and at least two rolling cutters, each coupled to a respective one of the at least two rolling cutter legs distally from the shank and adapted to rotate about the respective spindle axis of rotation, at least one of the rolling cutters having a spindle axis of rotation disposed at a pin angle that is either greater than 39 degrees and less than or equal to 180 degrees, or greater than or equal to 225 degrees and less than 393 degrees; and wherein the at least two rolling cutters are disposed at different pin angles.

2. The hybrid drill bit of claim 1, wherein the pin angle is greater than 39 degrees and less than or equal to 90 degrees.

3. The hybrid drill bit of claim 1, wherein the pin angle is greater than 90 degrees and less than or equal to 180 degrees.

4. The hybrid drill bit of claim 1, wherein the pin angle is greater than or equal to 225 degrees and less than or equal to 270 degrees.

5. The hybrid drill bit of claim 1, wherein the pin angle is greater than 270 degrees and less than 393 degrees.

6. A hybrid drill bit for use in drilling through subterranean formations, the hybrid drill bit comprising:

a shank disposed about a longitudinal centerline and adapted to be coupled to a drilling string;

at least one fixed blade extending in an axial direction downwardly and coupled to the shank;

at least one fixed cutting element arranged on the fixed blade;

at least two rolling cutter legs coupled to the shank, each comprising a spindle having a respective spindle axis of rotation, at least one of the rolling cutter legs having a spindle axis of rotation disposed at a pin angle that is either greater than 39 degrees and less than or equal to 180 degrees, or greater than or equal to 225 degrees and less than 393 degrees; and wherein the at least two rolling cutter legs are disposed at different pin angles.

7. The hybrid drill bit of claim 6, wherein the pin angle is greater than 39 degrees and less than or equal to 90 degrees.

8. The hybrid drill bit of claim 6, wherein the pin angle is greater than 90 degrees and less than or equal to 180 degrees.

9. The hybrid drill bit of claim 6, wherein the pin angle is greater than or equal to 225 degrees and less than or equal to 270 degrees.

10. The hybrid drill bit of claim 6, wherein the pin angle is greater than 270 degrees and less than 393 degrees.

11. A hybrid drill bit for use in drilling through subterranean formations, the hybrid drill bit comprising:

a shank disposed about a longitudinal centerline and adapted to be coupled to a drilling string;

at least one fixed blade extending in an axial direction downwardly and coupled to the shank;

at least one fixed cutting element arranged on the fixed blade;

at least two rolling cutter legs coupled to the shank, each comprising a spindle having a spindle axis of rotation disposed at a respective pin angle; and wherein the respective pin angles are different.

12. The hybrid drill bit of claim 11, wherein at least one of the pin angles is greater than 39 degrees and less than or equal to 90 degrees.

13. The hybrid drill bit of claim 11, wherein at least one of the pin angles is greater than 90 degrees and less than or equal to 180 degrees.

14. The hybrid drill bit of claim 11, wherein at least one of the pin angles is greater than or equal to 225 degrees and less than or equal to 270 degrees.

15. The hybrid drill bit of claim 11, wherein at least one of the pin angles is greater than 270 degrees and less than 393 degrees.

* * * * *